US011771942B2

(12) United States Patent
Casagrande

(10) Patent No.: US 11,771,942 B2
(45) Date of Patent: Oct. 3, 2023

(54) AUTOMATIC REGULATION SYSTEM FOR THE WEIGHT OF A DUMBBELL

(71) Applicant: Technogym S.p.A, Cesena (IT)

(72) Inventor: Simone Casagrande, Cesena (IT)

(73) Assignee: Technogym S.p.A, Cesena (IT)

( * ) Notice: Subject to any disclaimer, the term of this patent is extended or adjusted under 35 U.S.C. 154(b) by 142 days.

(21) Appl. No.: 17/528,287

(22) Filed: Nov. 17, 2021

(65) Prior Publication Data

US 2022/0152443 A1 May 19, 2022

(30) Foreign Application Priority Data

Nov. 17, 2020 (IT) ..... 102020000027507

(51) Int. Cl.
*A63B 21/075* (2006.01)
*A63B 21/072* (2006.01)
*A63B 21/00* (2006.01)

(52) U.S. Cl.
CPC ..... *A63B 21/075* (2013.01); *A63B 21/0726* (2013.01); *A63B 21/0728* (2013.01); *A63B 21/4035* (2015.10)

(58) Field of Classification Search
CPC ..... A63B 21/072; A63B 21/0724; A63B 21/0726; A63B 21/0728; A63B 21/075;
(Continued)

(56) References Cited

U.S. PATENT DOCUMENTS 7,121,988 B2 * 10/2006 Walkerdine ..... A63B 21/075 482/106
7,578,772 B2 * 8/2009 Lippitt ..... A63B 21/075 482/106

(Continued)

FOREIGN PATENT DOCUMENTS

CN 211158386 8/2020

OTHER PUBLICATIONS

Rapporto di Ricerca e l'Opinione Scritta [Search Report and Written Opinion] dated Aug. 11, 2021 From the Ministero Dello Sviluppo Economico, Direzione Generale Sviluppo Produttivo e Competitivita, Ufficio Italiano Brevetti e Marchi Re. Application No. IT202000027507. (28 Pages).

*Primary Examiner* — Joshua Lee

(57) ABSTRACT

The present invention relates to a system (S; S') for adjusting the weight of a dumbbell, that can be used by a user for carrying out a gymnastic exercise, comprising:

a supporting frame (1);

at least one dumbbell (2; 3), housed on said supporting frame (1), provided with a handgrip (21; 31), having an axial development along an axis (R), capable of rotating around said axis (R) and provided with a first end (211; 311) and a second end (212; 312), a first plurality of weights (P1; P3), arranged on said supporting frame (1), wherein each weight can be locked individually at said first end (211; 311) by means of first locking means (214; 314), when said handgrip (21; 31) rotates towards a locking position, and can be unlocked from said first end (211; 311), when said handgrip (21; 31) rotates towards an unlocking position, a second plurality of weights (P2; P4), arranged on said supporting frame (1), wherein each weight can be locked individually at said second end (212; 312) by means of second locking means (215; 315), when said handgrip (21; 31) rotates towards a locking position, and can be unlocked from said second end (212; 312), when said handgrip (21; 31) rotates towards an unlocking position, said system (S) being characterized in that it comprises at least one actuating device (4-4'; 5-5'), arranged on said supporting frame (1), configured for caus- (Continued)

ing the rotation of said handgrip (21; 31) around said axis (R), from said locking position towards said unlocking position and vice versa, so as to select the weight to be locked to or to be unlocked from said handgrip (21; 31) for carrying out the gymnastic exercise.

11 Claims, 7 Drawing Sheets

(58) Field of Classification Search
CPC ..... A63B 21/4035; A63B 24/0087; A63B 71/0036; A63B 2225/50
See application file for complete search history.

(56) References Cited

U.S. PATENT DOCUMENTS 7,604,578 B2 * 10/2009 Liu ..... A63B 21/0728 482/106
8,715,143 B2 * 5/2014 Svenberg ..... A63B 21/072 482/106
9,943,719 B2 * 4/2018 Smith ..... A63B 21/0728
10,022,583 B2 * 7/2018 Wang ..... A63B 21/0726
10,343,010 B2 * 7/2019 Chen ..... A63B 21/075
10,843,027 B2 * 11/2020 Wang ..... A63B 21/075
10,940,360 B2 * 3/2021 Dalebout ..... A63B 23/03516
11,040,235 B2 * 6/2021 Wang ..... A63B 21/075
11,040,236 B1 * 6/2021 Chen ..... A63B 21/0728
11,065,499 B2 * 7/2021 Chen ..... A63B 21/0728
11,167,167 B1 * 11/2021 Weng ..... A63B 21/0726
11,179,594 B2 * 11/2021 Chen ..... A63B 21/0728
11,191,993 B1 * 12/2021 Chen ..... A63B 21/075
11,198,031 B2 * 12/2021 Chen ..... A63B 21/072
2009/0042700 A1 * 2/2009 Liu ..... A63B 21/075 482/107
2009/0305852 A1 * 12/2009 Hoglund ..... A63B 21/0728 482/107
2010/0304939 A1 * 12/2010 Svenberg ..... A63B 21/0728 482/108
2013/0231224 A1 * 9/2013 Svenberg ..... A63B 21/072 482/107
2013/0324375 A1 12/2013 Svenberg
2014/0349820 A1 * 11/2014 Wang ..... A63B 21/063 482/108
2016/0184623 A1 * 6/2016 Moran ..... A63B 21/075 482/8
2017/0001061 A1 1/2017 Maijama et al.
2018/0078811 A1 * 3/2018 Chen ..... A63B 23/12
2018/0353794 A1 * 12/2018 Wang ..... A63B 71/0036

* cited by examiner

Sec. C-C

Sec. A-A

Sec. B-B

AUTOMATIC REGULATION SYSTEM FOR THE WEIGHT OF A DUMBBELL

RELATED APPLICATIONS

This application claims the benefit of priority of Italy Patent Application No. 102020000027507 filed on Nov. 17, 2020, the contents of which are incorporated herein by reference in their entirety.

FIELD AND BACKGROUND OF THE INVENTION

The present invention relates to an automatic regulation system for the weight of a dumbbell, in particular of a dumbbell for carrying out a gymnastic exercise.

More in detail, the invention relates to a system, designed and manufactured in particular for automatically regulate the weight amount to be loaded on a dumbbell for carrying out a strength gymnastic exercise, but that can be used for any gymnastic exercise that includes the use of a dumbbell.

In the following, the description will be directed to a dumbbell comprising a plurality of adjustable and selectable weights on the basis of the strength gymnastic exercise to be carried out, but it is clear that it should not be considered limited to this specific use.

As is well known, strength training systems are currently used to develop strength and improve the muscular resistance of a user.

Activities typically associated with strength training involve the use of resistance, often in the form of weights, to cause the muscles contraction of a user, increasing muscle strength and the function of tendons, ligaments, and joints.

Therefore workouts may require the use of free weights, such as barbells and dumbbells, wherein a user controls the movement or the position of these weights over a time period or for a number of sets and reps.

During the execution of the exercises with free weights, a user may do movements unconstrained by supportive equipment, and thus a user often carries out such movements in an equipment-free environment.

Usually, both dumbbells and barbells include a rod or handgrip, at the ends of which one or more weights, usually having a circular shape, are fixed on the base of the resistance required for the execution of the exercise.

Often the insertion of the weights on the rod is an operation that requires the user to stop doing exercises for a prolonged period, necessary to load or unload the weights.

Therefore, compact weight loading systems are common, mainly used for dumbbells, in which, by means of an actuating device, it is possible to select the weight from a plurality of weights already arranged near the rod, thus reducing the loading and unloading times by the user.

However, these known systems are manual, usually requiring the user to rotate the dumbbell grip to activate a weight locking and unlocking system.

Therefore known systems require the intervention of the user, who is forced to interrupt his training in order to adjust the intensity of the resistance necessary for the execution of strength exercises.

SUMMARY OF THE INVENTION

In the light of the above, it is, therefore, an object of the present invention to provide an automatic weight adjustment system for a dumbbell.

A further object of the present invention is to provide a mechanically simple and reliable system.

Another object of the invention is to provide a system that allows a user to remotely adjust the weight to be loaded on the dumbbell.

It is therefore specific object of the present invention a system for adjusting the weight of a dumbbell, that can be used by a user for carrying out a gymnastic exercise, comprising a supporting frame, at least one dumbbell, housed on said supporting frame, provided with a handgrip, having an axial development along an axis, capable of rotating around said axis and provided with a first end and a second end, a first plurality of weights, arranged on said supporting frame, wherein each weight can be locked individually at said first end by means of first locking means, when said handgrip rotates towards a locking position, and can be unlocked from said first end, when said handgrip rotates towards an unlocking position, a second plurality of weights, arranged on said supporting frame, wherein each weight can be locked individually at said second end by means of second locking means, when said handgrip rotates towards a locking position, and can be unlocked from said second end, when said handgrip rotates towards an unlocking position, said system may comprise at least one actuating device, arranged on said supporting frame, configured for causing the rotation of said handgrip around said axis, from said locking position towards said unlocking position and vice versa, so as to select the weight to be locked to or to be unlocked from said handgrip for carrying out the gymnastic exercise.

Further according to the invention, said system may comprise a logic control unit capable of sending control signals to said at least one actuating device.

Preferably according to the invention, said logic control unit may be connected with at least one remote device, for receiving signals corresponding to the weight adjustment.

Still according to the invention, said at least one dumbbell may comprise a gear fixed to said first end or to said second end, capable of engaging with said at least one actuating device.

Always according to the invention, said at least one actuating device may comprise a motor and a worm screw that can be actuated by said motor.

Further according to the invention, said gear may be capable of engaging on said worm screw, so as to cause the rotation of said handgrip around said axis, from said locking position towards said unlocking position and vice versa.

Preferably according to the invention, said at least one actuating device may comprise a motor, a first gear that can be actuated by said motor and a second gear, that can be actuated by said first gear.

Still according to the invention, said gear may be capable of engaging on said gear, so as to cause the rotation of said handgrip around said axis, from said locking position towards said unlocking position and vice versa.

Again according to the invention, said at least one actuating device may comprise a lock/unlock pin, capable of moving from an engagement position with said second gear, to a disengagement position from said second gear.

Further according to the invention, said supporting frame may comprise at least one lock/unlock pin capable of engaging with said at least one dumbbell for preventing rotation of said handgrip.

Preferably according to the invention, said system may comprise a second dumbbell housed on said supporting frame, comprising a handgrip, having an axial development along an axis, capable of rotating around said axis and provided with a first end and a second end, a first plurality of weights, arranged on said supporting frame, wherein each weight can be locked individually at said end by means of first locking means, when said handgrip rotates towards a locking position, and can be unlocked from said first end, when said handgrip rotates towards an unlocking position, a second plurality of weights, arranged on said supporting frame, wherein each weight can be locked individually at said second end by means of second locking means, when said handgrip rotates towards a locking position, and can be unlocked from said second end, when said handgrip rotates towards an unlocking position.

BRIEF DESCRIPTION OF THE SEVERAL VIEWS OF THE DRAWINGS

The present invention will be now described, for illustrative but not limitative purposes, according to its preferred embodiments, with particular reference to the figures of the enclosed drawings, wherein:

FIG. 10*a* shows an anterior front view of a component of the system of FIG. 8;

DESCRIPTION OF SPECIFIC EMBODIMENTS OF THE INVENTION

In the various figures, similar parts will be indicated with the same numerical references.

Figure 1:
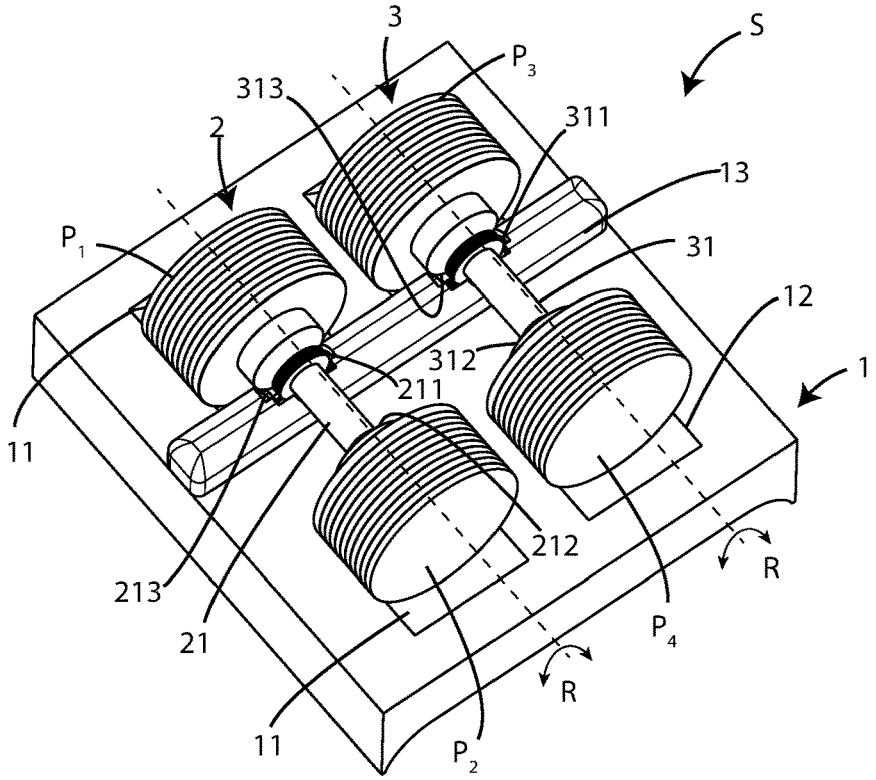
FIG. 1 shows a top perspective view of the automatic weight adjustment system for a dumbbell, object of the present invention.

With reference to FIG. 1, the automatic weight adjustment system S for a dumbbell, object of the present invention, essentially comprises a supporting frame 1, a first dumbbell 2, and a second dumbbell 3 housed on said supporting frame 1.

Said supporting frame 1 comprises a first pair of housings 11 and a second pair of housings 12.

Said supporting frame 1 also comprises a raise element 13.

Said first dumbbell 2 comprises a first handgrip 21, which extends axially according to an axis R, around which said first handgrip 21 is able to rotate clockwise and counterclockwise.

Said first handgrip 21 has a first end 211 and a second end 212.

A first plurality of weights P1 is associated with the first end 211, whereas a second plurality of weights P2 is associated with the second end.

Each weight of said first P1 and second P2 plurality of weights is shaped so as to ensure a shaped-coupling with the contiguous weights.

In a first embodiment, a gear 213 is arranged on said first end 211, integral with said first handgrip 21, in particular a toothed wheel.

Without departing from the scope of the present invention, said gear 213 can also be arranged on said second end 212.

Locking means are arranged on each of said first 211 and second 212 ends for fixing each weight to said first handgrip 21.

Figure 2:
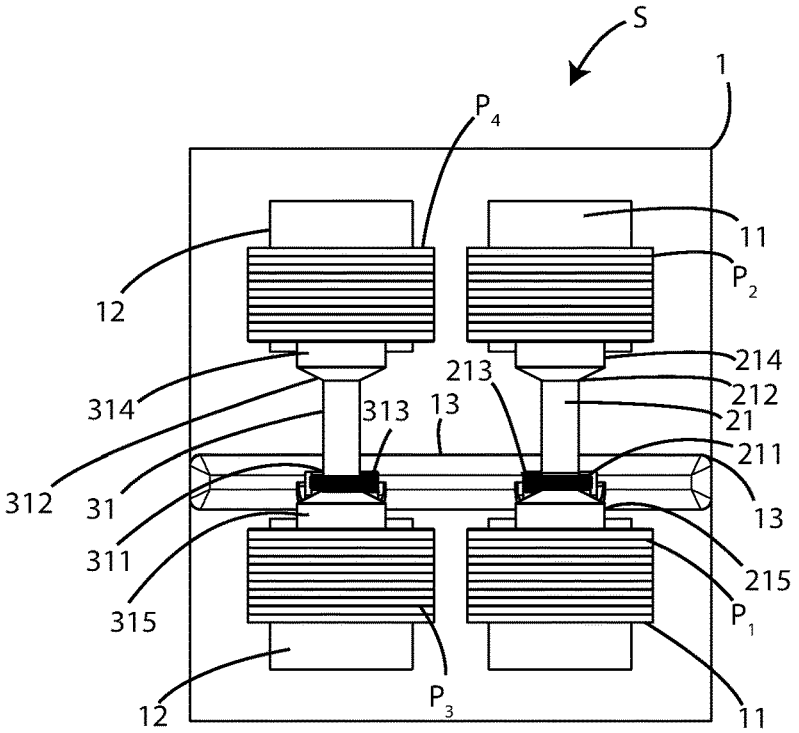
FIG. 2 shows a top view of the system shown in FIG. 1.
Figure 3:
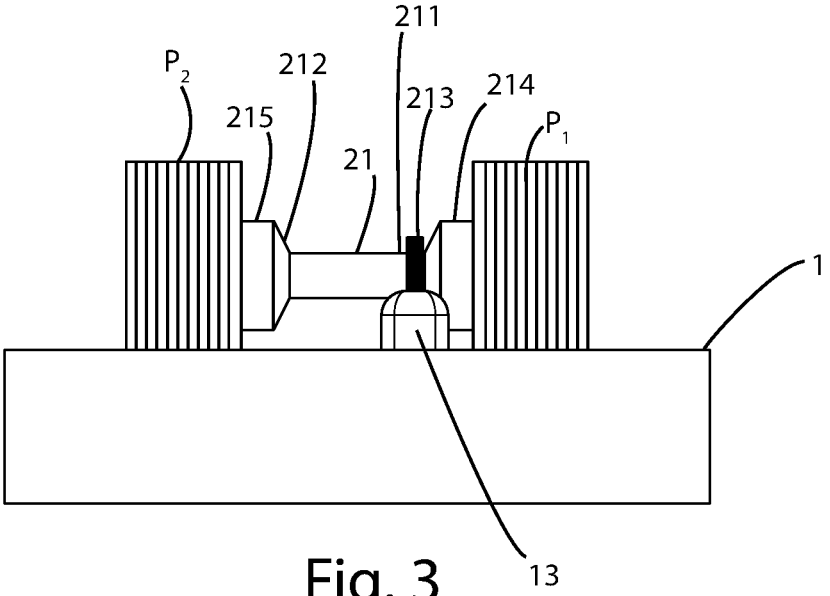
FIG. 3 shows a side view of the system shown in FIG. 1.

In particular, with reference to FIGS. 2 and 3, a first locking means 214 is fixed on said first end 211, whereas a second locking means 215 is fixed on said second end 212.

When said first dumbbell 2 rests on said supporting frame 1, said first plurality of weights P1 arranges in a housing of said first pair of housings 11, whereas said second plurality of weights P2 arranges in the remaining housing of said first pair of housings 11.

Said first handgrip 21 arranges raised and in contact with said raise element 13.

Figure 13:
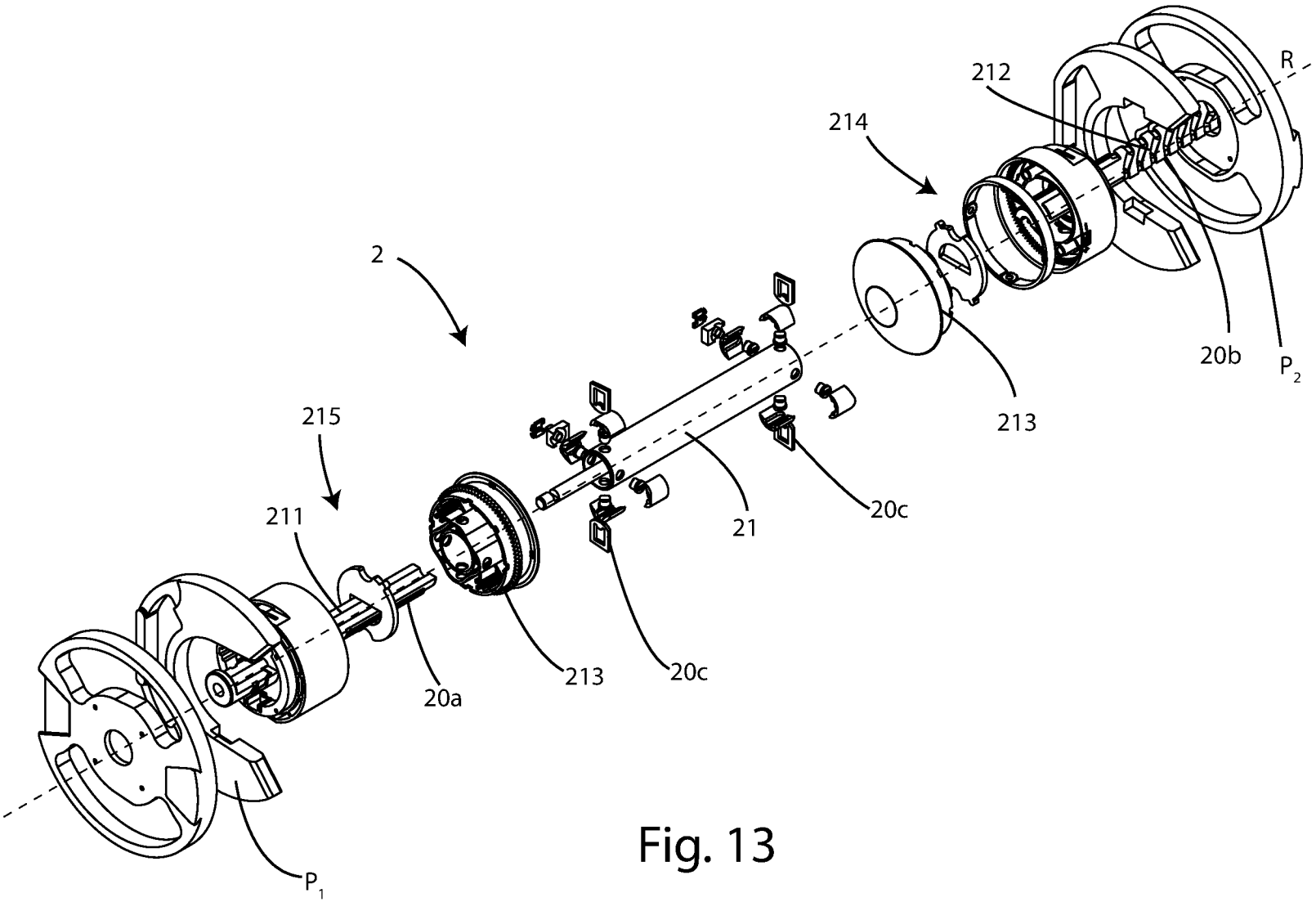
FIG. 13 shows an exploded view of the dumbbell shown in FIG. 10*b*.

Said handgrip 21, as well as said second handgrip 31, is a hollow cylindrical elongated body. Inside it, a first selector element 20*a* and a second selector element 20*b* are housed, on the surfaces of which helical grooves are formed, as shown in FIG. 13.

Said first 20*a* and second 20*b* selector element are movably coupled to said first handgrip 21, by means of a plurality of pins 20*c*, integral with said first handgrip 21.

Said first 20*a* and second 20*b* selector element are able to pass from a closing position, in which they are contained entirely inside said first handgrip 21 and facing each other, towards a plurality of opening positions wherein they move away from each other rotating according to said R-axis, moving according to opposite directions of said R-axis.

The rotation and therefore the progressive displacement of said first 20*a* and second 20*b* selector element is caused by the rotation of said first handgrip 21, transmitted to said first 20*a* and second 20*b* selector element by means of said plurality of pins 20*c* that are able to slide, as a cam, in the helical grooves of said first 20*a* and second 20*b* selector element. Similarly, the second dumbbell 3 has the same structure of said first dumbbell 2.

In particular, said second dumbbell 3 comprises a second handgrip 31 that axially develops according to the R-axis, around which said second handgrip 31 is able to rotate clockwise and counterclockwise.

Said second handgrip 31 has a first end 311 and a second end 312.

A first plurality of weights P3 is associated with the first end 311, whereas a second plurality of weights P4 is associated with the second end.

On said first end 311 a gear 313 is arranged, which is integral with said second handgrip 31, in particular a toothed wheel.

Without departing from the scope of the present invention, said gear 313 can also be arranged on said second end 312.

Locking means are arranged on each of said first 311 and second 312 ends for fixing each weight to said second handgrip 31.

In particular, with reference to FIG. 2, a first locking means 314 is fixed on said first end 311, whereas a second locking means 315 is fixed on said second end 312.

When said second dumbbell 3 rests on said supporting frame 1, said first plurality of weights P3 arranges in a housing of said second pair of housings 12, whereas said second plurality of weights P4 arranges in the remaining housing of said second pair of housings 12.

Said second handgrip 31 arranges raised and in contact with said raise element 13.

Figure 5:
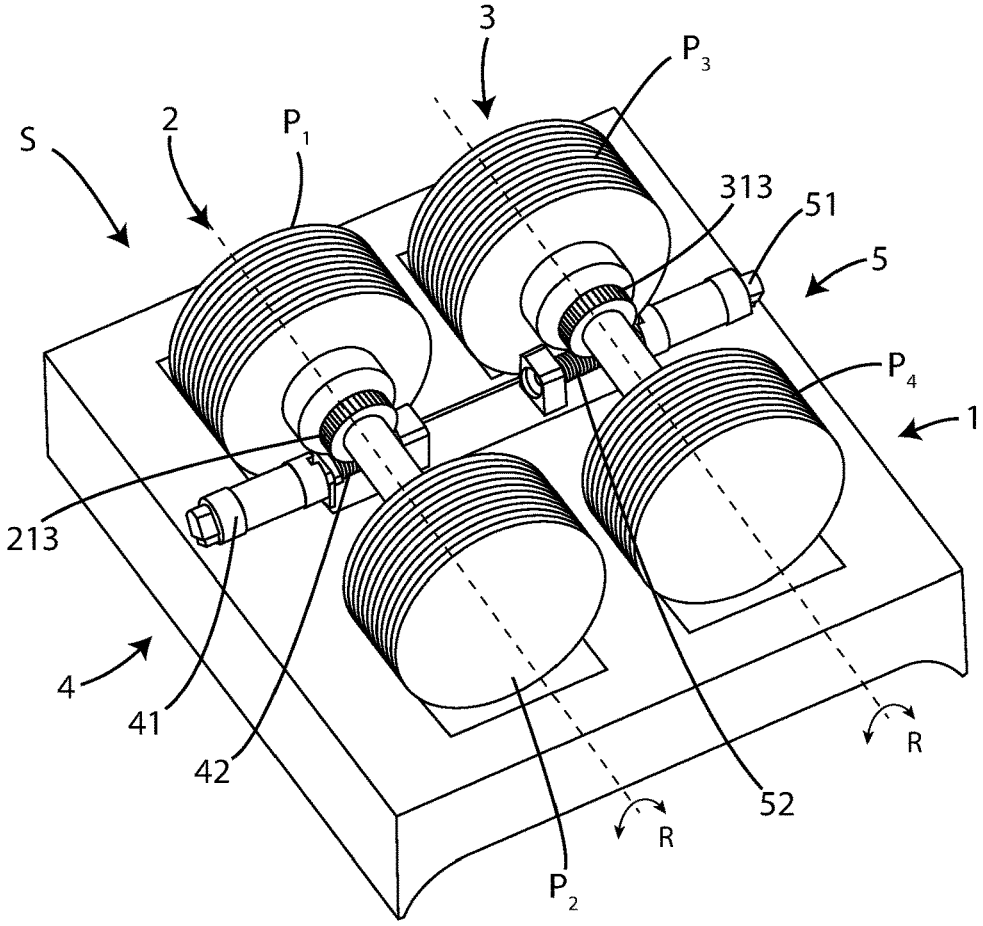
FIG. 5 shows a top perspective view without the covering carter of the system shown in FIG. 4.
Figure 6:
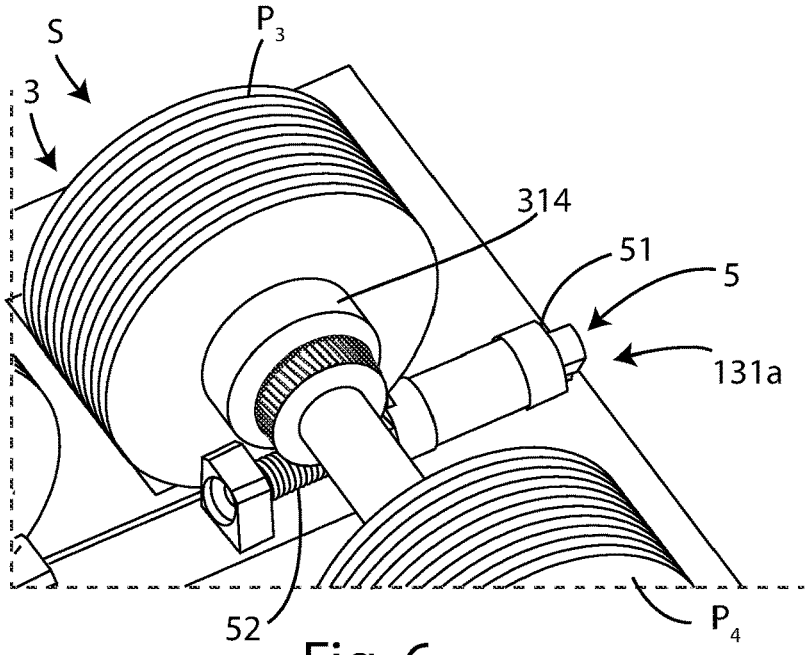
FIG. 6 shows a top view of a detail of the system shown in FIG. 5.
Figure 7:
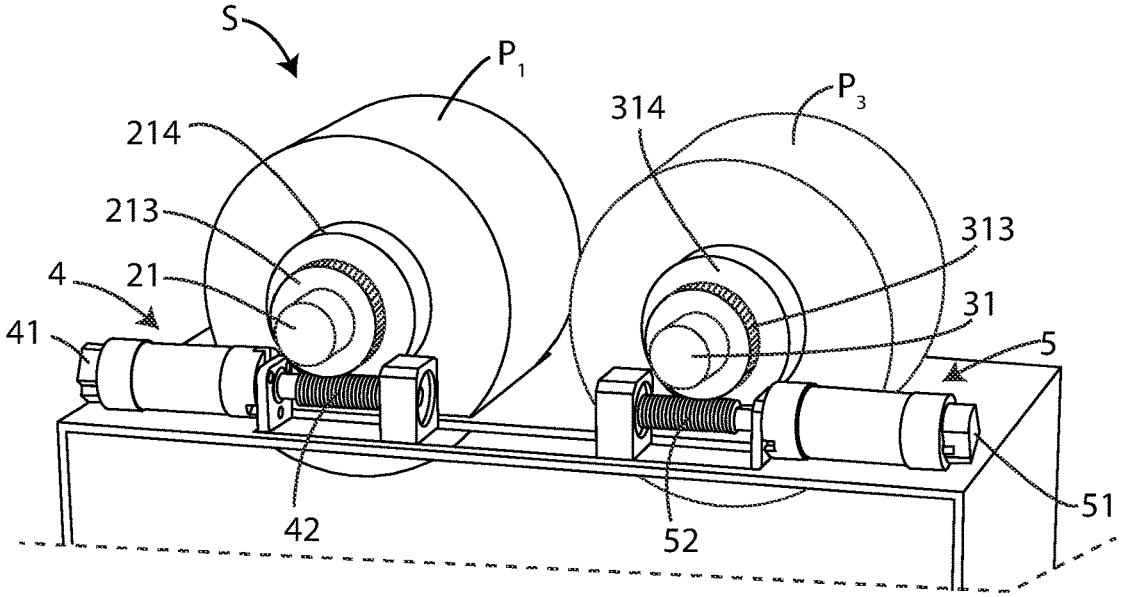
FIG. 7 shows a sectional side view of a detail of the system shown in FIG. 5.
Figure 8:
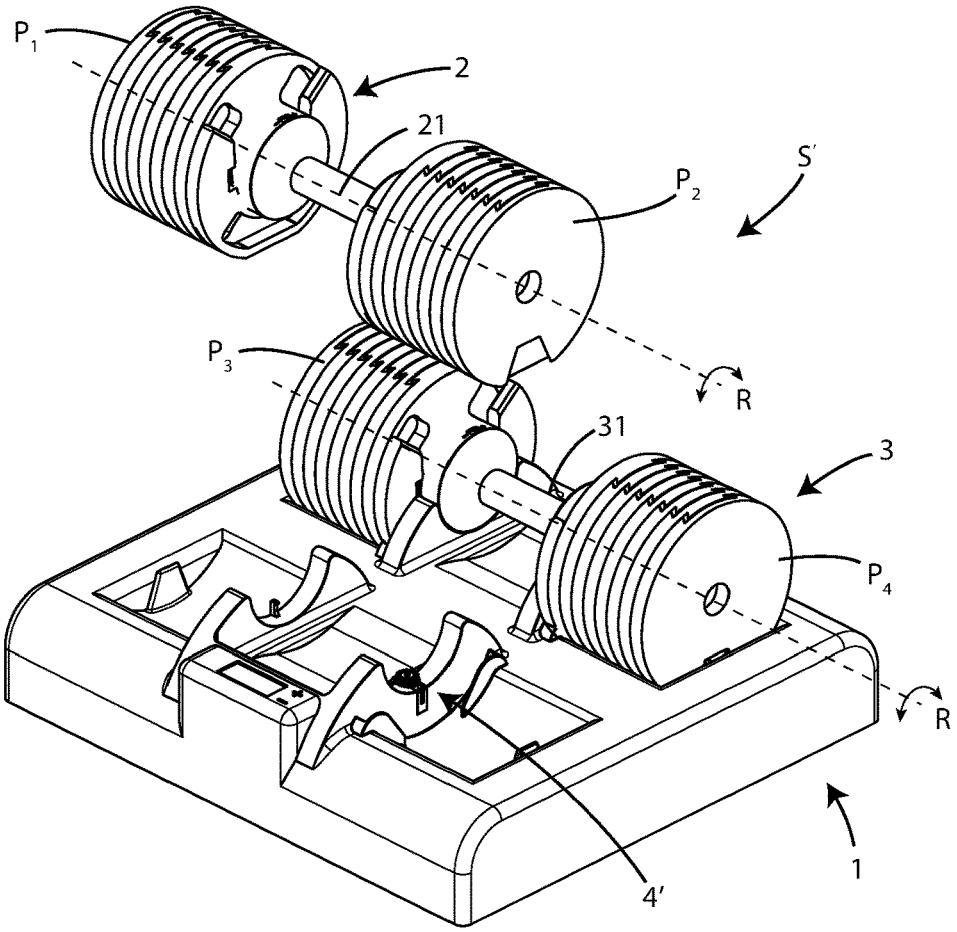
FIG. 8 shows a top perspective view of a second embodiment of the automatic weight adjustment system for a dumbbell, object of the present invention.
Figure 9:
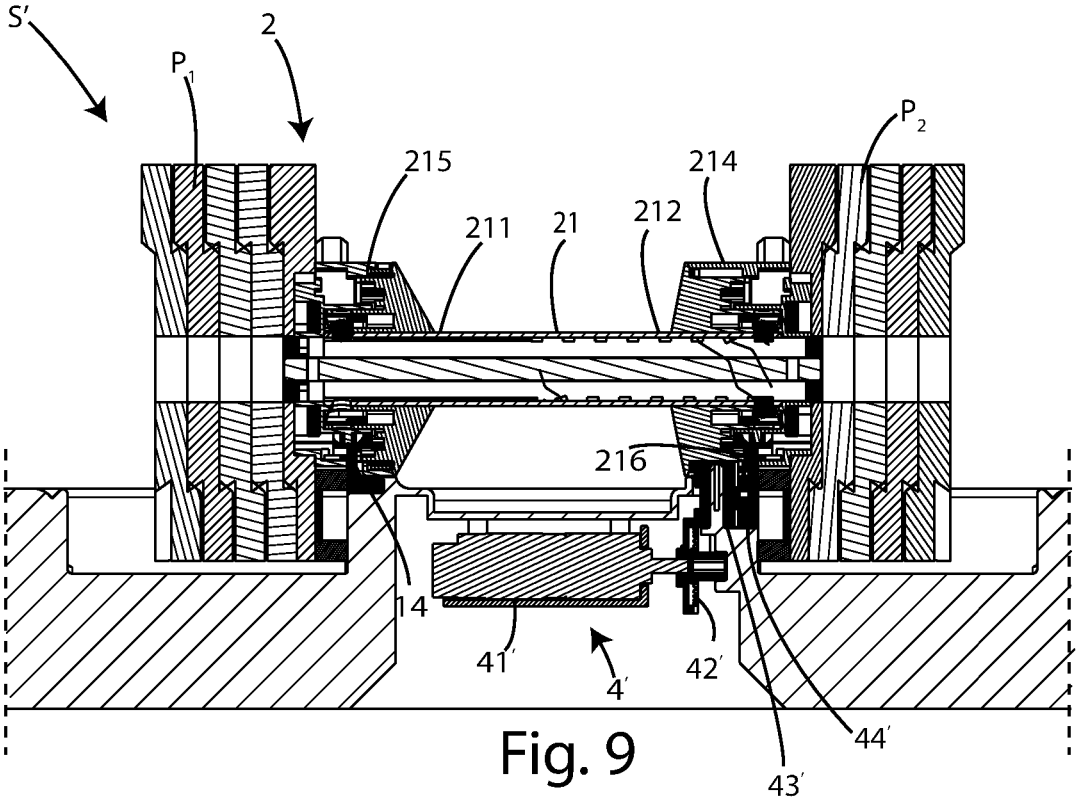
FIG. 9 shows a sectional front view of the system shown in FIG. 8.
Figure 10A:
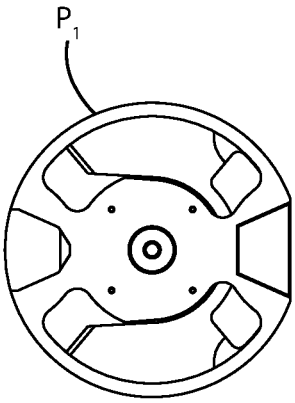
FIG. 10*a* shows an anterior front view of an element of the system of FIG. 8.
Figure 10B:
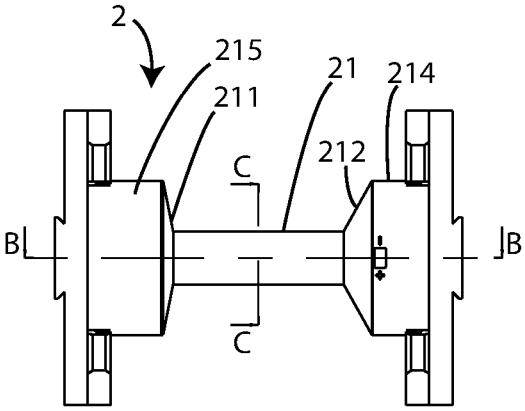
FIG. 10*b* shows a front view of a dumbbell comprised in the system of FIG. 8.
Figure 10C:
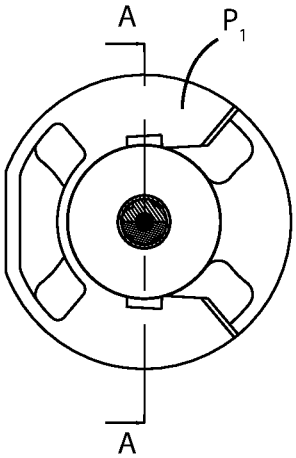
FIG. 10*c* shows a rear front view of the component shown in FIG. 10*a;*
Figure 11:
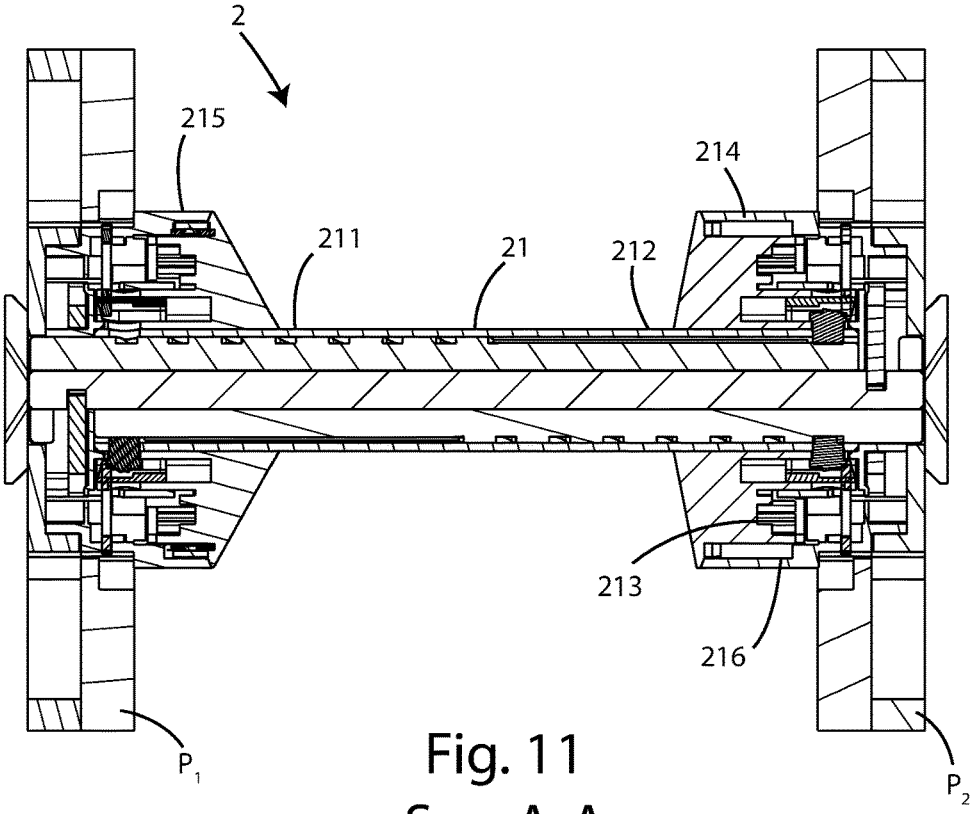
FIG. 11 shows a sectional front view of the dumbbell shown in FIG. 10*b;*
Figure 12:
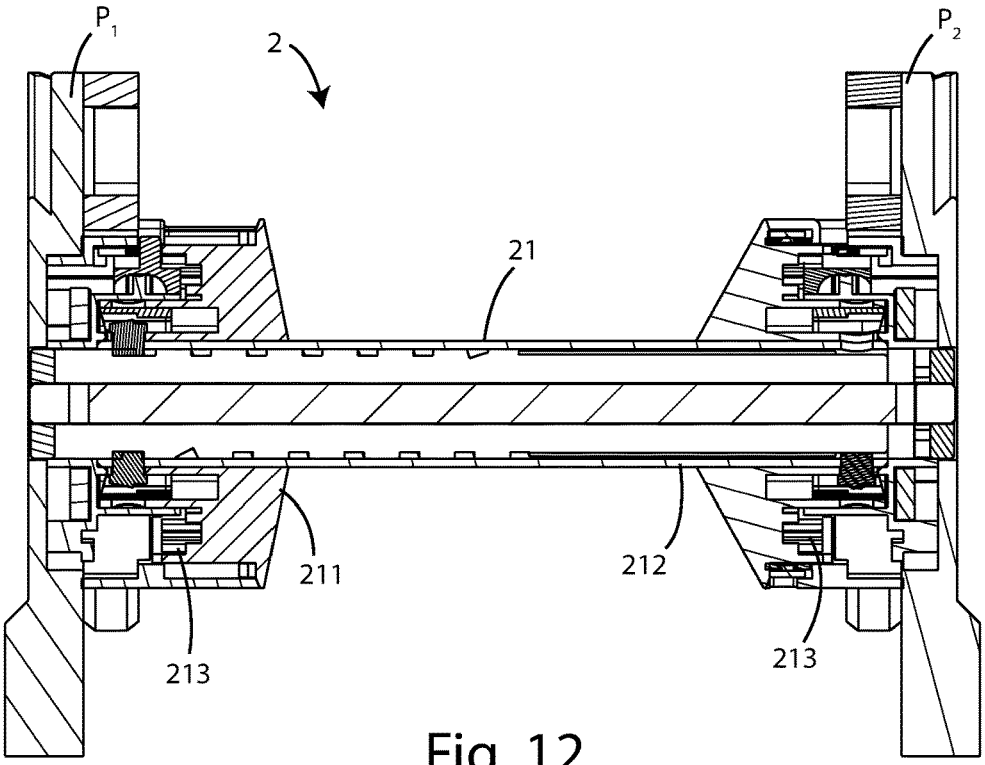
FIG. 12 shows a further sectional front view of the dumbbell shown in FIG. 10*b*.

With reference to FIGS. 5-7, said adjustment system S comprises a first actuating device 4 and a second actuating device 5.

Said first 4 and second 5 actuating devices are fixed to said supporting frame.

In particular, said first actuating device 4 is fixed near said first dumbbell 2, and said second actuating device 3 is arranged near said second dumbbell 3.

Said first actuating device 4 comprises a motor 41, which feeds a worm screw 42, rotatably coupled to said supporting frame 1, whereas said second actuating device 5 comprises a motor 51, which feeds a worm screw 52, rotatably coupled to said supporting frame 1.

In particular, said worm screw 42 engages with said gear 213 of said first dumbbell 2, causing the rotation of said first handgrip 21 around said R-axis, whereas said worm screw 52 engages with said gear 313 of said second dumbbell 3, causing the rotation of said second handgrip 31 around said R-axis.

Figure 4:
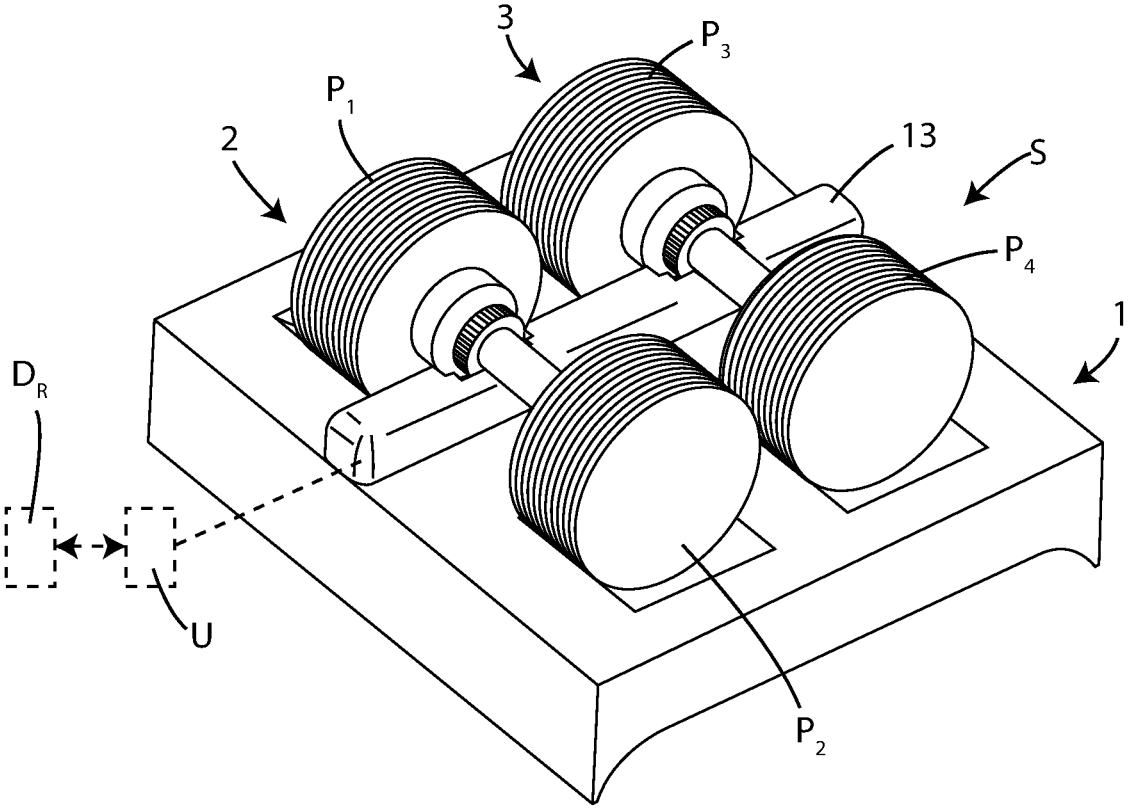
FIG. 4 shows a further top perspective view with covering carter of the system shown in FIG. 1.

With reference to FIG. 4, said system S comprises a logic control unit U capable of sending control signals for the operation of said first 131 and second 131' actuating device.

In particular, said logic control unit U sends signals to said motors 41 and 51, so as to select the number of weights from said plurality of weights P1, P2, P3, and P4 to be blocked to said first 21 and second 31 handgrip for carrying out a gymnastic exercise.

Said logic control unit U is capable of exchanging signals by means of wireless connections of the wireless or Bluetooth® types with a remote device $D_R$, such as a smartphone or the like.

The operation of the automatic weight adjustment system S for a dumbbell object of the present invention is as follows.

When a user wishes to carry out a strength exercise using a first dumbbell 2 and/or a second dumbbell 3, it is initially necessary to adjust the weight of said first dumbbell 2 and/or second dumbbell 3 before lifting it from the supporting frame 1.

The description refers to the first dumbbell 2, however, it is unchanged also for the second dumbbell 3.

Said motor 41 puts in rotation said worm screw 42, which engages with said gear or toothed wheel 213 of said first dumbbell 2.

Since said toothed wheel 213 is integral with said first handgrip 21, this starts rotating towards a weight locking or unlocking position, around said R-axis.

The rotation of said first handgrip 21 causes the rotation of said plurality of pins 20*c*, which, moving in the helical grooves of said first 20*a* and second 20*b* selector element, cause their rotation and therefore the displacement from said closing position towards said opening positions, which correspond to the number of weights to be taken from said plurality of weights P1 and P2.

Said first selector element 20*a* progressively inserts into the holes of each weight of said first plurality of weights P1, whereas said second selector element 20*b* progressively inserts into the holes of each weight of said second plurality of weights P2.

The weights are coupled together by means of shape coupling, so that, by lifting the first dumbbell 2 from said supporting frame 1, the selected weights from said first 20*a* and second 20*b* selector element remain integral with the first dumbbell 2, whereas the not selected weights remain housed on said supporting frame 1.

The user can select on the remote device $D_R$ the amount of weight to be used for carrying out a gymnastic exercise.

The remote device $D_R$ sends corresponding signals to said logic control unit U, which in its turn sends command signals to said motor 41.

Said motor 41, by activating said worm screw 42, puts in rotation said first handgrip 21, around said rotation R-axis, from a locking position to an unlocking position and vice versa, for locking or unlocking the weights of said first P1 and second P2 plurality of weights.

With reference to FIGS. 8-13, a second embodiment of the system S' is described, which is different from the system S described above, for the actuating device.

In particular, in the second embodiment, said system S' comprises a first actuating device 4' for said first dumbbell 2, and a second actuating device 5' for said second dumbbell 3.

Said first actuating device 4' comprises a motor 41', a first gear 42', and a second gear 43'.

Said first actuating device 4' also comprises a lock/unlock pin 44'.

Said lock/unlock pin 44' is capable of passing from an engagement position to a disengagement position with said second gear 43', following the actuation by said first dumbbell 2, and of passing from said disengagement position to said engagement position with said gear, due to a spring, when said first dumbbell 2 is not inserted in said supporting frame 1.

Furthermore, in this second embodiment, said first dumbbell 2 also comprises a lock/unlock pin 216, and said second dumbbell 3 also comprises a lock/unlock pin 316.

Said lock/unlock pin 216 is capable of passing from a lowered position to a raised position by means of a spring, not shown in the figure.

Similarly, said lock/unlock pin 316 is capable of passing from a lowered position to a raised position by means of a spring, not shown in the figure.

Similarly, said second actuating device 5' comprises a motor 51', a first gear 52', and a second gear 53'.

Said second actuating device 5' also comprises a lock/unlock pin 54'.

Said lock/unlock pin 54' is capable of passing from a first engagement position to a second disengagement position with said third gear 53', by means of a spring not shown in the figure.

Said motor 41' is capable of putting in rotation said first gear 42', which puts in rotation said second gear 43'.

Said second gear 43' engages with said gear 213 of said first dumbbell 2, which therefore causes the rotation of said first handgrip 21.

Said lock/unlock pin 216 of said first dumbbell 2 is able to come in contact with said lock/unlock pin 44' of said first actuating device 4' and to cause its displacement from said first engagement position towards said second disengagement position with said second gear 43', as will be described in detail below.

Furthermore, in this second embodiment, said supporting frame 1 also comprises a first fixed pin 14 capable of engaging with an opening obtained in said second locking means 215, so as to prevent the rotation of said first handgrip 21.

Furthermore, said supporting frame 1 also comprises a second fixed pin 15 capable of engaging with an opening obtained in said second locking means 315, so as to prevent the rotation of said second handgrip 31.

The operation of said second embodiment of said system S' takes place as described for the previous embodiment.

In particular, it differs in the following features.

The description refers to the first dumbbell 2, however, it remains unchanged also for the second dumbbell 3.

When said first dumbbell 2 rests on said supporting frame 1, said lock/unlock pin 216 of the first dumbbell 2 is in contact with said lock/unlock pin 44' of said first actuating device 4', pushing it downwards, therefore said lock/unlock pin 44' of said first actuating device 4' is in said second disengagement position.

Therefore, on the basis of the weight selected by the user, said motor 41' puts in rotation said first gear 42', which puts in rotation said second gear 43', which, in turn, puts in rotation said gear 213 of said second dumbbell 2.

Since said gear 213 is integral with said first handgrip 21, this begins to rotate towards a weight locking or unlocking position, around said R-axis.

Consequently, the ends of said first handgrip 21 extend and engage or disengage from said first P1 and second P2 plurality of weights, as described for the first embodiment.

By means of said opening 214*a*, it is possible to display the number corresponding to the selected weight.

When said first dumbbell 2 is lifted by the user from said supporting frame 1, a spring pushes down said lock/unlock pin 216 of said first dumbbell 2, blocking its rotation, at the same time, a spring pushes into the first engagement position said lock/unlock pin 44' of said supporting frame 1, which locks said second gear 43' of said first actuating device 4'.

As is evident from the above description, the adjustment system object of the present invention allows the automatic and mechanically simple and reliable adjustment of the weight of a dumbbell for carrying out a gymnastic exercise.

The present invention has been described for illustrative but not limitative purposes, according to its preferred embodiments, but it is to be understood that modifications and/or changes can be introduced by those skilled in the art without departing from the relevant scope as defined in the enclosed claims.

What is claimed is:

1. A system (S; S') for adjusting the weight of a dumbbell, that can be used by a user for carrying out a gymnastic exercise, comprising:

a supporting frame (1);

at least one dumbbell (2; 3) housed on said supporting frame (1) and provided with:

a handgrip (21; 31) having an axial development along an axis (R), capable of rotating around said axis (R) and provided with a first end (211; 311) and a second end (212; 312);

a first plurality of weights (P1; P3) arranged on said supporting frame (1), wherein each weight can be locked individually at said first end (211; 311) by means of first locking means (214; 314) when said handgrip (21; 31) rotates towards a locking position, and can be unlocked from said first end (211; 311) when said handgrip (21; 31) rotates towards an unlocking position;

a second plurality of weights (P2; P4) arranged on said supporting frame (1), wherein each weight can be locked individually at said second end (212; 312) by means of second locking means (215; 315) when said handgrip (21; 31) rotates towards a locking position, and can be unlocked from said second end (212; 312) when said handgrip (21; 31) rotates towards an unlocking position;

said system (S) being characterized in that it comprises at least one actuating device (4-4'; 5-5') arranged on said supporting frame (1), configured for causing the rotation of said handgrip (21; 31) around said axis (R) from said locking position towards said unlocking position and vice versa, so as to select the weight to be locked to or to be unlocked from said handgrip (21; 31) for carrying out the gymnastic exercise.

2. The system (S; S') according to claim 1, characterized in that it comprises a logic control unit (U) capable of sending control signals to said at least one actuating device (4-4'; 5-5').

3. The system (S; S') according to claim 1, characterized in that said logic control unit (U) can be connected with at least one remote device ($D_R$), for receiving signals corresponding to the weight adjustment.

4. The system (S; S') according to claim 1, characterized in that said at least one dumbbell (2; 3) comprises a gear (213; 313) fixed to said first end (211; 311) or to said second end (212; 312), capable of engaging with said at least one actuating device (4-4'; 5-5').

5. The system (S) according to claim 1, characterized in that said at least one actuating device (4; 5) comprises a motor (41; 51) and a worm screw (51; 52) that can be actuated by said motor (41; 51).

6. The system (S) according to claim 5, wherein said at least one dumbbell (2; 3) comprises a gear (213; 313) fixed to said first end (211; 311) or to said second end (212; 312), capable of engaging with said at least one actuating device (4-4'; 5-5') and wherein said gear (213; 313) is capable of engaging on said worm screw (42; 52), so as to cause the rotation of said handgrip (21; 31) around said axis (R) from said locking position towards said unlocking position and vice versa.

7. The system (S') according to claim 1, characterized in that said at least one actuating device (4'; 5') comprises a motor (41'; 51'), a first gear (42'; 52') that can be actuated by said motor (41'; 51') and a second gear (43'; 53') that can be actuated by said first gear (42'; 52').

8. The system (S') according to claim 7, wherein said at least one actuating device (4'; 5') comprises a motor (41'; 51'), a first gear (42'; 52') that can be actuated by said motor (41'; 51') and a second gear (43'; 53') that can be actuated by said first gear (42'; 52') and wherein said gear (213; 313) is capable of engaging on said second gear (43'; 53'), so as to cause the rotation of said handgrip (21; 31) around said axis (R) from said locking position towards said unlocking position and vice versa.

9. The system (S') according to claim 7, characterized in that said at least one actuating device (4'; 5') comprises a lock/unlock pin (44'; 55') capable of moving from an engagement position with said second gear (43'; 53') to a disengagement position from said second gear (43'; 53').

10. The system (S') according to claim 7, characterized in that said supporting frame (1) comprises at least one lock/ unlock pin (216; 316) capable of engaging with said at least one dumbbell (2; 3) for preventing rotation of said handgrip (21; 31).

11. The system (S; S') according to claim 1, characterized in that it comprises a second dumbbell (3) housed on said supporting frame (1) comprising

- a handgrip (31) having an axial development along an axis (R), capable of rotating around said axis (R) and provided with a first end (311) and a second end (312);
- a first plurality of weights (P3) arranged on said supporting frame (1), wherein each weight can be locked individually at said end (311) by means of first locking means (314) when said handgrip (31) rotates towards a locking position, and can be unlocked from said first end (311) when said handgrip (31) rotates towards an unlocking position;
- a second plurality of weights (P4) arranged on said supporting frame (1), wherein each weight can be locked individually at said second end (312) by means of second locking means (315) when said handgrip (31) rotates towards a locking position, and can be unlocked from said second end (312) when said handgrip (31) rotates towards an unlocking position.

* * * * *